United States Patent [19]

Steininger

[11] Patent Number: 4,511,407

[45] Date of Patent: Apr. 16, 1985

[54] METHOD OF CLEANING CORRODED METAL ARTICLES BY INDUCTION HEATING

[75] Inventor: David A. Steininger, Santa Clara, Calif.

[73] Assignee: Electric Power Research Institute, Inc., Palo Alto, Calif.

[21] Appl. No.: 438,017

[22] Filed: Nov. 1, 1982

[51] Int. Cl.[3] ..... B08B 3/10

[52] U.S. Cl. ..... 134/1; 134/3; 134/19; 134/41; 165/95

[58] Field of Search ..... 134/1, 3, 19, 41, 22.19; 165/95

[56] References Cited

U.S. PATENT DOCUMENTS

| | | | |
|---|---|---|---|
| 2,118,480 | 5/1938 | Somes | 134/19 X |
| 2,256,873 | 9/1941 | Somes . | |
| 2,425,134 | 8/1947 | Strickland | 134/19 |
| 2,527,666 | 10/1950 | Winter . | |
| 2,739,829 | 3/1956 | Pedlow et al. . | |
| 3,325,309 | 6/1967 | Sutula et al. | 134/19 X |
| 3,546,018 | 12/1970 | Hittel et al. . | |
| 3,578,072 | 5/1971 | Kolm . | |
| 3,664,870 | 5/1972 | Oberhofer et al. | 134/3 |
| 3,923,580 | 12/1975 | Leatherman . | |
| 4,046,591 | 9/1977 | Laguerre . | |
| 4,082,683 | 4/1978 | Galesloot | 252/178 X |
| 4,257,819 | 3/1981 | Abe et al. | 134/19 |

FOREIGN PATENT DOCUMENTS

| | | | |
|---|---|---|---|
| 45-13681 | 5/1970 | Japan | 134/19 |

*Primary Examiner*—Marc L. Caroff

*Attorney, Agent, or Firm*—Flehr, Hohbach, Test, Albritton & Herbert

[57] ABSTRACT

A method is provided for removing corrosion products from metallic articles having an interior surface and exterior surface, comprising the step of contacting one of said surfaces to be cleaned with a substantial amount of fluid which is effective for removing corrosion at a predetermined temperature while simultaneously exposing the other of such surfaces to an induction heating means.

7 Claims, 4 Drawing Figures

METHOD OF CLEANING CORRODED METAL ARTICLES BY INDUCTION HEATING

The present invention is directed to a method of removing corrosion products from metallic particles. In particular, the present invention is directed to a method for removing corrosion products such as magnetite from pressurized water reactor steam generators in power plants.

The uncontrolled growth of corrosion products on metallic articles may result in weakening and deformation of heat exchanger components. This is a particularly costly problem in industrial plants wherein repair or replacement of large components due to corrosion is particularly costly, not only due to the expense of the equipment which needs to be replaced but also in the down time which it causes in the plant. Corrosion is especially a problem in plants which use pressurized water reactor steam generators, since such generators are particularly susceptible to build up of the corrosion product magnetite. The build up of magnetite may result from corrosion of the generator tube support plates which may result in tube deformation (termed denting) and can also lead directly to generator tube corrosion.

In particular, power utilities have approached a problem with dented steam generator units by plugging the steam generator tubes to avoid use of the particular affected tube, and at a later stage either undergoing the expense of chemical cleaning of the generator or replacement of the generator entirely.

However, a problem arises if chemical cleaning processes are used on dented steam generator tubes. Once a steam generator tube has dented, the formation of magnetite corrosion has probably proceded to an extent that the tube support plate may have partially cracked and the inner surfaces of the cracks are corroded and filled with magnetite. While the magnetite may to some degree support the plate, removal of the magnetite by chemical cleaning may significantly weaken the support plate and cause disintegration and/or collapse of the entire plate. In addition, the chemical cleaning agent also has a corrosive action on the cracks and on uncorroded tube and tube support plate materials, and generator weld material thereby causing further degradation and/or damage of the generator.

Since the magnetite corrosion found between the generator tube and tube support plate crevices is extremely tenacious and exists within a tightly enclosed inaccesible region, to remove this deposit a relatively high chemical reaction rate is normally required along with a relatively high replenishment rate of the chemical cleaning agent. Both of these requirements have an adverse corrosive affect on the steam generator materials, such as support plates, shroud, weld, etc.

It is therefore an object of the present invention to provide a method whereby chemical cleaning agents may be used to remove corrosive products, such as magnetite, in relatively inaccessible areas, by the action of chemical cleaning solvents whereby the corrosion is removed without substantially affecting the uncorroded metal and weld material of the steam generator.

Figure 1:
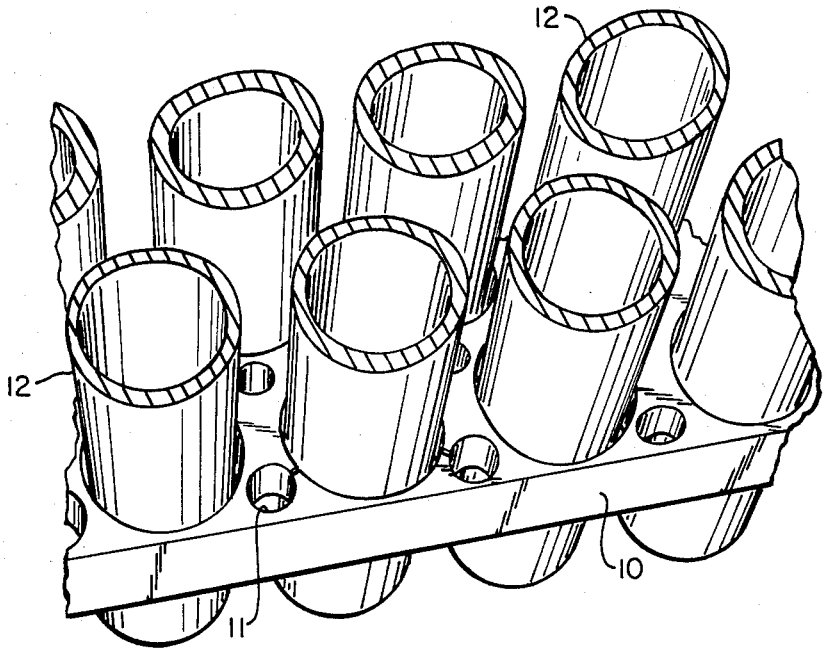
FIG. 1 is a perspective view of pressurized water reactor steam generator tubes and a tube support plate.

The present invention provides a method whereby corrosion products are removed from metallic articles. In particular, when such metallic articles are in a form having an interior surface and an exterior surface, the method comprises contacting the surface to be cleaned with a substantial volume of chemical cleaning agent which removes the corrosion products at a predetermined temperature, while simultaneously exposing the other surface to an induction heating means, whereby the corrosion product on the surface to be cleaned and/or the chemical cleaning solvents is heated locally near the corrosion product to at least the predetermined temperature, and the metallic surfaces on the article in contact with the cleaning agent in the vicinity of the heating means is substantially maintained below the predetermined temperature by heat dissipation into the volume of cleaning agent. Additionally, metallic surfaces away from the vicinity of heating is maintained at the low bulk temperature of the chemical cleaning solvent in which it is in contact. The heating of the corrosion product is accomplished via three mechanisms. Heat is conductively transferred from the generator tube material which is inductively heated if the corrosion product is in contact with the tube. Heat is transferred from the inductively heated generator tube to the chemical cleaning solvent in the vicinity of the corrosion product. Depending on the characteristics of the corrosion product it will be inductively heated directly.

The present invention is particularly suited for removal of any type of corrosion which may be dissolved or chemically treated to be removable by a cleaning agent with acceptable temperature-reaction rate characteristics. The articles which may be cleaned according to the present invention may be any metallic article. In particular, the method according to the present invention is particularly useful for cleaning of corroded generator tubes and corroded generator tube support plates in pressurized water reactor steam generators of nuclear power plants. The corrosion on such generator tube and support plates comprise mostly magnetite, which may be removed by the cleaning action of various chelating agents, such as polycarboxylic acids. The reaction which takes place to remove the magnetite normally will take place at an elevated temperature. According to the present invention the magnetite corrosion and/or the cleaning agent is elevated to the predetermined temperature and removed by the action of the chemical cleaning agent without causing damage to the adjacent support plate or steam generator metallic material. The members adjacent to the area being heated are prevented from reaching a temperature at which the chemical reaction rate is significant with the cleaning agent by dissipation of the excess heat into the bulk volume of cleaning agent which surrounds the metallic article. In this manner, only the magnetite or other corrosion on the generator tube and in the tube support plate crevice will be dissolved by the chemical cleaning agent.

The chemical cleaning agents which may be used according to the present invention may be any chelating agent known to act upon corrosion such as a magnetite and which have acceptable temperature-reaction rate characteristics. In particular, the preferred cleaning agents comprises the group consisting of essentially poly acids such as EDTA, HEDTA, (hydroxy EDTA), DTPA (diethylene triamine pentaacetic acid) and NTA (nitrilotriacetic acid) and NTMP (nitrilotrimethylene phosphonic acid). One preferred cleaning agent is NTA which is particularly effective for dissolving magnetite in the temperature range of 250°–450° F. Table 1 below shows the percent weight of $Fe_3O_4$ of magnetite corrosion product which reacted with the various chelating agents at three temperatures, 302° F., 400° F. and 482° F. As may be seen from the table, at temperatures as low as 302° F. all of the indicated chelating reagents reacted with substantially all of the magnetite corrosion.

TABLE I

Reaction of 5 wt % chelant solutions with magnetite at the temperature indicated. Initial pH = 8.0. Heating periods = 10 hr. Reaction mixtures consisted of 1 ml chelant solution and 5 mg of magnetite.

| | | wt % of $Fe_3O_4$ reacted | | |
|---|---|---|---|---|
| Chelant | Magnetite | 302° F. | 400° F. | 482° F. |
| EDTA | $Fe_3O_4$[a] | 99[c] | 101 | 97 |
| | $Fe_3O_{4.17}$[b] | 100 | 99 | 77 |
| HEDTA[d] | $Fe_3O_4$ | 99 | 99 | 97 |
| | $Fe_3O_{4.17}$ | 101 | 101 | 84 |
| DTPA | $Fe_3O_4$ | 101 | 101 | 94 |
| | $Fe_3O_{4.17}$ | 101 | 101 | 96 |
| NTA | $Fe_3O_4$ | 54 | 99 | 101 |
| | $Fe_3O_{4.17}$ | unknown | 100 | 100 |

[a]Mapico Black (Cities Service Co.) reduced to stoichiometric $Fe_3O_4$ by heating for 4.5 hours at 500° C. in 93 mole % $N_2$, 7% $H_2$ presaturated with water vapor at room temperature.
[b]Untreated Mapico Black
[c]A value of 5% at the lower temperature of 93° C. was found in previous work.
[d]Hydroxyethylethylenediamine Triacetic acid is not to be confused with the protonated form of EDTA.

Figure 3:
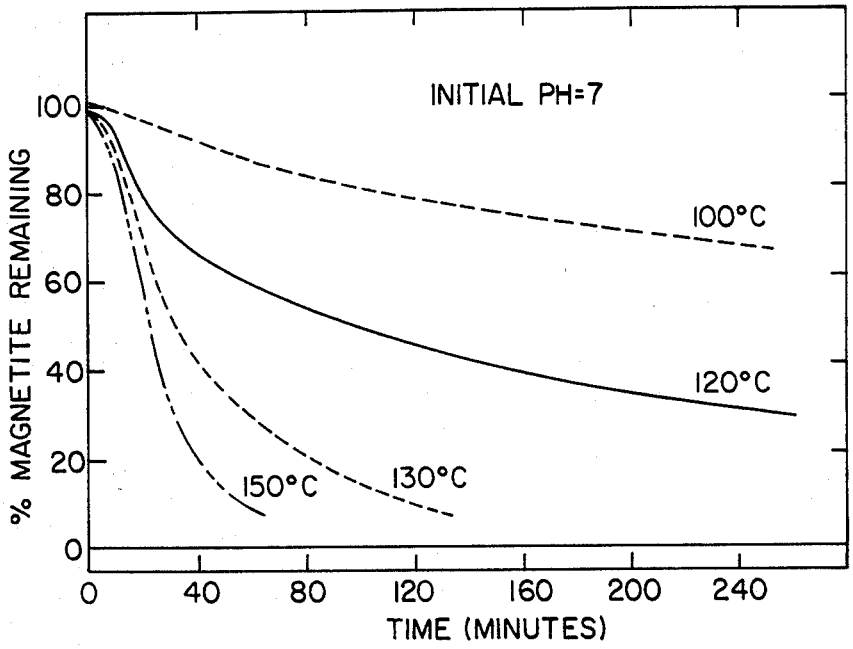
FIG. 3 is a plot showing the rate of dissolution of magnetite at initial pH 7 in 5% ammoniated EDTA at 100° C., 120° C., 130°, and 150°.

Another preferred cleaning solution is ammoniated EDTA. FIG. 3 shows the kinetic curves for the dissolution of magnetite in ammoniated EDTA solutions, initially adjusted to the designated pH value of 7. The reaction is seen to be relatively fast and complete at the higher temperatures 130°–150° C. at 100° C., however, reaction is considerably slower.

Figure 4:
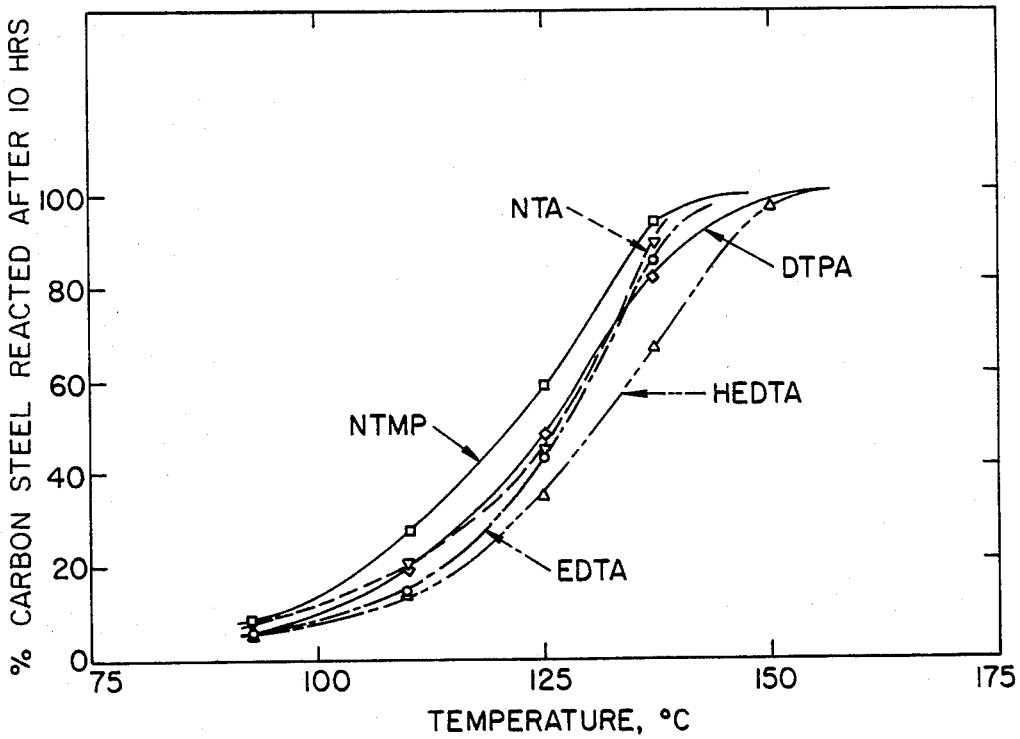
FIG. 4 is a plot of corrosivity of 5% (weight) chelant solution at initial pH 7 in carbon steel as a function of temperature using chelating agents NTA, NTMP, EDTA, HEDTA, DTPA.

Ideally, a chemical cleaning agent should react with and preferably dissolve the corrosion product at an acceptable rate, while showing negligible reactivity toward exposed metal and weld surfaces. For pressurized water reactor steam generators, the material most likely to corrode under chemical cleaning agent exposure is carbon steel and associated weld metal. FIG. 4 shows the kinetic curves for the reaction of carbon steel with some of the chemical cleaning agents mentioned earlier. All of the chemical cleaning agents are seen to be quite passive to carbon steel at environmental temperatures below 100° C. Therefore, as long as exposed metal surfaces within the steam generator only contact the chemical cleaning agent at temperatures below 100° C., their reaction with the agent will be negligible. Only the corrosion product which sees environmental temperatures as high as 200° C. will react with the chemical cleaning agent.

While the present invention is particularly adaptable to the removal of magnetite, other types of corrosion, particularly corrosion comprising oxides of iron, may also be removed according to the present invention. The only requirement is that the selected chelating agent react with the specific corrosive product at a predetermined temperature and that the predetermined temperature is attainable by use of the inductive heating means. The metallic article which may be cleaned according to the present invention may be any of the common metals used in fabricating industrial components, such as iron, steel, stainless steel and the like. The present method is particularly applicable to pressurized water reactor steam generators in nuclear power plants which are fabricated of the alloy Inconel which consists essentially of about 76% by weight nickel, about 15% chromium and about 9% iron.

Referring to FIG. 1 there is shown a typical pressurized water reactor steam generator tube and tube support plate assembly. The tube support plate 10 accommodate a plurality of flow holes 11 and tube holes for supporting tubes 12. In typical operation of the steam generator, hot liquid from the nuclear pile or other heat source is flowed through tubes 12. The exterior of tubes 12 and the tube support plate 10 are contacted with an external source of water, thereby generating steam.

Figure 2:
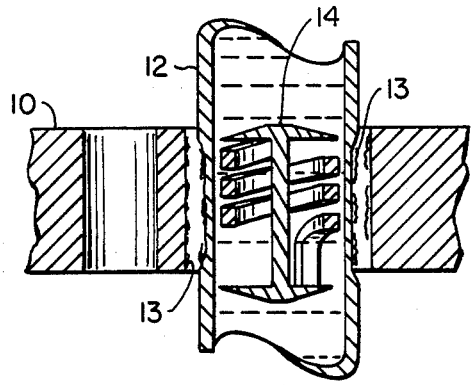
FIG. 2 is a cross-section of a steam generator tube support plate and tube accommodating an induction heater.

Referring to FIG. 2 there is shown a cross-section of a single generator tube 12 and a tube support plate 10. The tube 12 is not firmly affixed to the support plate 10 and therefore there is normally a small crevice between the exterior of the tube 12 and the interior of the tube hole in plate 10. It is in this crevice where a substantial amount of the magnetite corrosion 13 accumulates. Furthermore, as the magnetite grows the exterior of tube 12 is subjected to considerable pressure may eventually dent, collapse and crack. Additionally, the magnetite within the crevice even if self-limiting in growth, can lead to conditions which will cause the generator tube to corrode and weaken. In accordance with the present invention, the entire exterior of tube 12 and the support plate 10 are immersed in a cleaning solution at a temperature within a range of 68° F. to 150° F. An induction heater 14 is inserted into tube 12 to a point adjacent to the intersection of the tube and tube support plate. When the heater is on, the magnetite 13 and the locally present chemical cleaning agent within the crevice between the tube and tube support plate is heated to the temperature at which the cleaning solvent is effective, i.e., at 300° F.–500° F., whereas the adjacent metallic areas of the steam generator including tube and tube support plate remain at substantially lower temperatures due to conduction through the metallic parts and dissipation into the large volume of cleaning solution which surrounds the tube and tube support plates. By this method, the magnetite is selectively heated and removed whereas the surrounding metallic areas of the tube and tube support plate remain substantially unaffected by the action of the cleaning agent. The induction heating element 14 can be moved along the length of tube 12 at each point of intersection with a tube support plate and thereby the entire steam generator may be cleaned.

Conventional induction heaters may be utilized in accordance with the present invention. The specifications of a particularly preferred induction heater design are given below in Table II.

TABLE II

Multiturn Inductor Design Parameter Range

| | |
|---|---|
| Conductor thickness | AWG 25 wire (.0179 inch diameter) |
| Coil length | 1 inch |
| Coil conductor material | copper[1] |
| Applied voltage | 400 volts @ generator |
| Applied frequency | 50 KHz |
| Coil efficiency | 91%–98% |

TABLE II-continued

| Multiturn Inductor Design Parameter Range | |
|---|---|
| Coil power factor | 0.51–0.75 |
| Coil (VA) | 11.84 KVA–6.41 KVA |
| Number of coil returns | 50–40 |
| Volts/coil return | 7.7–9.36 |
| Ampere-turns | 1542–684 |
| Coil current | 31 amperes–17 amperes |
| Coil copper loss | 540 watts–112 watts |
| Concentrator material | ferrite |

[1]Electrical insulation of the copper wire is provided by a layer of polymide film coated with a fluorocarbon resin.

In another embodiment according to the present method, in some cases tube 12 may be of such a small diameter that the heat which must be generated by the induction heater may be such that the heat intensity which is required would be sufficient to melt the induction heater. In such a case cooling fluid such as water may be flowed through tubes 12 to provide additional cooling. Even with such internal cooling of the tubes the fraction of inductive heat which would be generated would normally still be sufficient to allow the magnetite to reach the desired temperature.

Particular embodiments of the present invention have been disclosed above, however, the invention is not limited to these specific embodiments. In view of the foregoing disclosure, variations and modifications thereof will be apparent and it is intended to include within the invention all such variations and modifications except those which are not within the scope of the appended claims.

What is claimed is:

1. A method for removing iron oxide corrosion from a metallic tube and tube support assembly comprising the steps of (a) contacting said tube support assembly and exterior of said tube with a substantial volume of fluid cleaning agent at a temperature lower than a predetermined temperature range, said predetermined temperature range being that range in which said agent chemically removes said corrosion, (b) introducing an induction heating means into the interior of said tube at a location adjacent to said corrosion;

(c) locally heating said tube by said induction heating means for a period sufficient to raise the temperature of said cleaning agent in the vicinity of said heating means to a temperature within said predetermined temperature range to remove said corrosion, while adjacent metallic surfaces of said tube and tube support assembly are substantially maintained below said predetermined temperature range by heat dissipation into said volume of fluid cleaning agent.

2. The method according to claim 1 where said corrosion product comprises magnetite.

3. A method according to claim 1 comprising the additional step of contacting the interior surface of said tube with a cooling stream of fluid.

4. The method according to claim 2 wherein said fluid cleaning agent comprises a chelant selected from the group consisting of poly acids.

5. The method according to claim 4 wherein said polycarboxylic acid is selected from ethylenediaminetetraacetic acid, hydroxyethylenediaminetetraacetic acid, diethylenetriaminepentaacetic acid, nitrilotriacetic acid, and nitrilomethylene phosphonic acid.

6. The method according to claim 5 wherein said polycarboxylic acid is nitrilotriacetic acid and said predetermined temperature range is 250° to 400° F.

7. A method according to claim 6 wherein said metallic tube consists essentially of an alloy consisting of about 76% by weight nickel, about 15% chromium and about 9% iron.

* * * * *